US012753610B2

(12) United States Patent
Tollak

(10) Patent No.: US 12,753,610 B2
(45) Date of Patent: Oct. 6, 2026

(54) PACKED ROOF WINDOW PRODUCT

(71) Applicant: VKR Holding A/S, Hørsholm (DK)

(72) Inventor: Tobias Tollak, Aarhus (DK)

(73) Assignee: VKR Holding A/S (DK)

( * ) Notice: Subject to any disclaimer, the term of this patent is extended or adjusted under 35 U.S.C. 154(b) by 227 days.

(21) Appl. No.: 18/699,289

(22) PCT Filed: Oct. 7, 2022

(86) PCT No.: PCT/DK2022/050211
§ 371 (c)(1),
(2) Date: Apr. 7, 2024

(87) PCT Pub. No.: WO2023/057032
PCT Pub. Date: Apr. 13, 2023

(65) Prior Publication Data

US 2024/0426109 A1 Dec. 26, 2024

(30) Foreign Application Priority Data

Oct. 8, 2021 (DK) ..... PA 2021 70503

(51) Int. Cl.
*E04D 15/04* (2006.01)
*B65D 25/22* (2006.01)

(52) U.S. Cl.
CPC ..... *E04D 15/04* (2013.01); *B65D 25/22* (2013.01); *B65D 2255/00* (2013.01); *E04D 2015/042* (2013.01)

(58) Field of Classification Search
CPC ..... B65D 5/10; B65D 5/20; B65D 5/2052; B65D 5/42; B65D 5/427; B65D 5/44; B65D 25/22; B65D 77/04; B65D 77/042; B65D 85/30; E04D 13/03; E04D 15/04; E04D 2015/042
USPC ..... 229/120.37
See application file for complete search history.

(56) References Cited

U.S. PATENT DOCUMENTS

| | | | |
|---|---|---|---|
| 2,008,875 | A | 7/1935 | Peterson et al. |
| 6,189,777 | B1 | 2/2001 | Hutchinson et al. |
| 2008/0148692 | A1 | 6/2008 | Wisevercar et al. |
| 2014/0263595 | A1 | 9/2014 | Pantelleria |
| 2019/0002154 | A1 | 1/2019 | Hugley |
| 2022/0371771 | A1 | 11/2022 | Ghini |

(Continued)

FOREIGN PATENT DOCUMENTS

| | | |
|---|---|---|
| EP | 1710163 | 10/2006 |
| EP | 2748071 | 4/2013 |
| WO | WO2013050041 | 4/2013 |

(Continued)

OTHER PUBLICATIONS

International Search Report dated Jan. 30, 2023 issued in connection with International Application No. PCT/DK2022/050211, two (2) pages.

(Continued)

*Primary Examiner* — Bryon P Gehman
(74) *Attorney, Agent, or Firm* — Merek, Blackmon & Voorhees, LLC

(57) ABSTRACT

A packed roof window product comprising a plurality of differently sized roof window related product components accommodated in a box, wherein one or more of the components are held in a sub-packaging, which sub-packaging is attached to a side wall for the box, by a flap extending across the side wall.

20 Claims, 16 Drawing Sheets

(56) References Cited

U.S. PATENT DOCUMENTS

| | | | |
|---|---|---|---|
| 2024/0425232 | A1 | 12/2024 | Henriksen |
| 2024/0425258 | A1 | 12/2024 | Tollak |

FOREIGN PATENT DOCUMENTS

| | | |
|---|---|---|
| WO | WO2014096146 | 6/2014 |
| WO | WO2021180288 | 9/2021 |

OTHER PUBLICATIONS

U.S. Appl. No. 18/699,285, filed Apr. 7, 2024.
U.S. Appl. No. 18/699,288, filed Apr. 7, 2024.

PACKED ROOF WINDOW PRODUCT

TECHNICAL FIELD

The present invention relates to packed roof window product comprising a plurality of differently sized roof window related product components accommodated in a box, wherein the box in a supply condition has a bottom side and a top side, which bottom side and top side are spaced apart along a height axis and side walls of the box extend between the bottom side and top side of the box along the height axis, said bottom side, top side and side walls delimiting an internal space of the box, and wherein a first of the side walls extends along a primary axis, which primary axis is perpendicular to the height axis, and the first side wall has an upper edge extending along the primary axis along the top side, an outer surface facing away from the internal space, and an inner surface facing towards the internal space, wherein a first of the components or a collection of components is accommodated by a sub-packaging, the sub-packaging being accommodated in the internal space of the box, the sub-packaging comprising a main body, which main body delimits an internal space accommodating the first component or component collection.

BACKGROUND ART

When installing windows in a roof it is vital to ensure that the roof window itself is securely attached to the roof structure and that the joint between the roof window and the roof structure is properly weather proofed. It is therefore important that all components of roof window products, such as the roof window itself or a flashing assembly for a roof window, are used and are used in the right way. To facilitate this, the components are typically arranged in the box in an intended order of use and small components, such as screws, are kept in plastic bags. Furthermore, blocks of expanded polystyrene or similar shock absorbing material are used for protecting the product and/or for keeping the components in the intended position within the box. An example of a packed roof window, where these principles are used, is known from EP2748071B1 and an example of a packed flashing assembly for a roof window is known from EP1710163B1. Traditionally small components have been attached to the box or to larger components, for example by means of an adhesive, to prevent them from becoming lost, either inside the box or when removed from the box, and/or they have been wrapped in plastic, thereby also preventing them from scratching or otherwise damaging other components. Larger components have traditionally been kept in place in the box by being attached to the box by means of an adhesive or by being fixated between blocks of expanded polystyrene (EPS), and some have been covered by a protective plastic film to prevent them from being scratched.

While this has functioned well in terms protecting the components, it also leads to an overall packaging which contains a large number of separate packaging elements, e.g. positioning elements, plastic strips or the like, which may be made from different materials. As the packaging needs to be collected and sorted, a large number of elements decreases the likelihood of it actually being collected and recycled after installing the window.

Fixating components by glue or adhesives may decrease the number of components to be collected and recycled, if additional sub-packaging is not used along with the glue, but glue is not easily removed from the packaging material and when recycling the material used for the box, foreign matter may lead to the material being classified as lower grade of material. Pure material is more easily recycled and are thus more valuable for recycling. For example, cardboard recycling is classified in several grades, with limitations on contaminants such as glue.

SUMMARY OF INVENTION

With this background, it is an object of the invention to provide a packed roof window product, which has a smaller climate footprint and/or with improved recyclability, without increasing the risk of errors in the installation of the product and while maintaining a good protection of the components during transportation.

These and further objects are achieved with a packed roof window product of the kind mentioned in the introduction, which is furthermore characterised in that the sub-packaging further comprises an attachment flap projecting from the main body, and that the sub-packaging is attached to the first side wall of the box by the attachment flap extending across the first side wall from the inner surface to the outer surface.

By providing a sub-packaging with an attachment flap, the sub-packaging can be retained in relation to the side wall of the box without using separate fixation means such as adhesives or plastic straps, while still preventing the sub-packaging from moving around inside the box during transport. The attachment flap allows the sub-packaging to be retained or fixated by employing the structure of the box, rather than separate fixation means. In this way, the number of packaging pieces is potentially reduced, which increases the likelihood of the packaging material being recycled, as it reduces the need for the installer to collect and sort packaging after installing the window. As the sub-packaging and the attachment flap can be made of the same material as the box, such as a paper-based material, the recyclability of overall packaging of the roof window product is improved.

Another potential advantage of having the sub-packaging attached to the side wall in this manner is that it may provide the opportunity of using the sub-packaging as a positioning element or a spacer element for other components which are packed in the box, eliminating material used for dedicated positioning or spacing elements.

A still further potential advantage of attaching the sub-packaging to the first side wall in this manner may be that the height dimension of the box may be employed to a greater extent, as the sub-packaging need not rest on the bottom of the box. The components of a packed roof window product typically have different sizes and hence one or more larger components may determine the height dimension of the box. This typically leads to unused space above other components. By attaching the second packing to the side wall by the attachment flap it may allow this space to be used, potentially reducing the size of the box and in turn reducing material consumption.

These advantages contribute to the overall recyclability of the packaging of the roof window product and in turn its climate footprint.

A still further potential advantage of using an attachment flap to attach the sub-packaging to the side wall is that it provides a simple packing and unpacking process. The details of this is described in relation to the specific embodiments.

The box is typically of a rectangular configuration where the top side and bottom side extend in parallel to each other and four side walls extend perpendicularly thereto in between the bottom and top sides. In such a case the height axis is parallel with the side walls and two of the side walls extend along the primary axis and the remaining two side walls extend along a secondary axis, which secondary axis is perpendicular to the height axis and the primary axis. The primary and secondary axis may be denoted a longitudinal axis and a transverse axis, respectively. The height of the box in along the height axis is usually smaller than both the length of the box along the primary axis and the width of the box along the secondary axis, providing a flat box in which the top side and bottom side form major sides of the box and the side walls form minor sides. Major and minor here refers to the area of the side. The width of the box may be larger than the length of the box.

The term supply condition denotes the packed state of the roof window product, in which it is supplied to the user. The box is described herein with reference to a bottom side and a top side with side walls extending in between. These terms are understood in terms of their function when packing the roof window product, the top side being the side which is open when the roof window product is packed in the box, allowing components to be placed in the box. Subsequently the top side is closed to provide the supply condition. The top side may also be denoted a lid of the box. The surfaces of the box which face the internal space of the box in the supply condition are herein denoted as inner surfaces, whereas surfaces facing away from the internal space will be denoted as outer surfaces. The box can comprise overlapping portions, and hence an outer surface is not necessarily also an exterior surface of the box.

The packed roof window product comprises a plurality of roof window related product components, and the first component is carried by the side wall, while at least some of, preferably a majority of, the other components are placed on the bottom side of the box, either directly or resting on top of one or more other components. Some of the other components may be glued to the bottom side or kept in place by positioning elements.

The packed roof window product may comprise additional components or component collections in further separate pieces of sub-packaging attached to the side walls of the box by attachment flaps.

The attachment flap is understood to extend across the side wall in the sense that it extends from the inner surface of the first side wall to the outer surface of the first side wall. The attachment flap may be in contact with one or both of these surfaces.

In some embodiments the main body is in contact with the inner surface of the first side wall. Preferably, the wall of the main body from which the attachment flap projects rests against the inner surface of the first side wall.

In some embodiments, the box and/or the sub-packaging is/are made from a paper-based material such as carton or cardboard, the box preferably being made from corrugated cardboard.

Cardboard and other paper-based material is readily recyclable and by providing all packaging elements made from such materials the likelihood of it being recycled is increased considerably as there is no need for sorting the packaging in fractions. Cardboard can also be made as a suitably flexible material, allowing it to easily extend across the first side wall.

In some embodiments, the attachment flap is integrally formed with the sub-packaging. In this way the likelihood of the material of the sub-packaging material actually being recycled is increased considerably, while also simplifying manufacture of the sub-packaging.

In some embodiments, the attachment flap comprises a first section and a second section, which first and second sections are delimited from each other by a folding zone of the attachment flap, wherein the first section extends along the inner surface of the first side wall and the second section extends along the outer surface of the first side wall.

By providing the folding zone of the attachment flap, the attachment flap can be folded across the side wall of the box during packing and when the box is closed and brought to the supply condition, the top side of the box may fixate the attachment flap to the side wall. The attachment flap is suitably folded across an upper edge of the first side wall, the upper edge being the free upper edge of a panel of cardboard forming the first side wall which is located furthest from the bottom side, possibly being formed by a fold in the cardboard panel. In this way the top side of the box is used to fasten the sub-packaging element, without separate fixation means beyond the existing structure of the box. Providing the folding zone as a pre-made zone in the attachment flap may also allow the position of the sub-packaging in relation to the side wall to be controlled, facilitating the correct placement of the sub-packaging during packing. The folding zone may comprise two or more folding lines, which may for example be pre-defined by embossing lines into the material of attachment flap. Also, or alternatively, the folding zone may comprise a section of material, which is weaker than the rest of the attachment flap allow the folding zone to assume a curved shape. For corrugated cardboard, the folding zone may be a compressed zone. Also, or alternatively, the folding zone may consist of a different material than the rest of the attachment flap.

The first section may extend in parallel to and be in contact with the inner surface of the first side wall and the second section may extend in parallel to and be in contact with the outer surface. Friction between attachment flap and first side wall may then keep the sub-packaging from sliding along the first side wall.

In some embodiments, the main body of the sub-packaging has a length Lb as seen along the primary axis, and the attachment flap has a length Lf as seen along the primary axis, wherein the length Lf exceeds the length Lb. By providing a long attachment flap in this way, friction is increased, improving the fixation of the sub-packaging in relation to the side wall. A long attachment flap may also increase the stability of the attachment of the sub-packaging by reducing the risk of the sub-packaging turning.

In some embodiments, the top side of the box is formed by a lid of the box, and in the supply condition, the attachment flap is retained in relation to the first side wall of the box by being arrange between the first side wall and the lid of the box. The lid thus provides a means of fixating the attachment flap which is integrated in the box. The lid may be a hinged lid, e.g. a panel of the box which is attached to a side wall of the box, but other box types could be used e.g. a telescopic box type. When the lid is closed the lid engages the attachment flap and fixates the sub-packaging. The attachment flap is thus sandwiched in between the first side wall and lid. In addition to requiring no separate fixation means, a simple packing process is also obtained. The sub-packaging is simply positioned at the first side wall, with its attachment flap extending across the first side wall, and when the lid is closed the sub-packaging is fixated. When the box is opened, the sub-packaging is released and is easily retrievable for the installer.

In a further development, the box comprises an overlap panel, which overlap panel in the supply condition overlaps with an outer surface of the first side wall and with a part of the attachment flap which is positioned at the outer surface of the first side wall.

The overlap panel is typically provided on the top side of the box and is used to keep the box closed in the supply condition. It may be glued or otherwise fastened to the outer surface of the first side wall. The second section of the attachment flap is thus sandwiched in between the first side wall and the overlap panel, and thus retained in relation to the first side wall. Overlap panels are found in boxes of the five-panel fold type and the telescopic type which are presently preferred but could possibly be incorporated in other box types.

A five-panel fold type box (sometimes referred to as five-panel-folder) is a standard box type, where fifth panel is provided to overlap with another panel in the closed state of the box. Telescopic boxes are also a standard box type, wherein the box comprises two pieces, which can be fitted to each other such that side walls of one piece is at least partly overlapped by side walls of the other piece.

In a further development, the overlap panel and/or the first side wall is provided with a zone of reduced thickness, such as a compressed zone, and said zone corresponds in size and shape at least to the part of the attachment flap which is positioned at the outer surface of the first side wall.

Typically, overlap panels are attached with a strip of adhesive to the outer surface of the side wall which it overlaps to close the box. However, as part of the attachment flap is positioned on the outer surface, it may prevent the overlap panel from resting flush against the outer surface and thus inhibit the efficiency of the adhesive. By providing a zone of reduced thickness on the overlap panel or the side wall in the area of the attachment flap, space for the attachment flap is provided, improving contact between the outer surface and the overlap panel and in turn improving attachment. Providing the zone of reduced thickness in the first side wall, provides a retracted position for the attachment flap, whereas providing the zone of reduced thickness in the overlap panel provides space for the attachment flap. For corrugated cardboard boxes the reduced thickness is easily provided by compression of the corrugated cardboard.

In some embodiments, the first side wall comprises a recess in an upper edge of the first side wall, and the attachment flap is folded across the side wall at the recess. This may provide a slightly retracted position of the attachment flap in relation the upper edge, allowing the box to be closed in a flush manner.

In some embodiments, the attachment flap extends across the first side wall by extending through a cut in the first side wall of the box. The cut will typically correspond in size to a cross-section of the attachment flap and provides additional fixation of the sub-packaging to the side wall. The attachment flap may extend through multiple cuts in the side wall in a weaved solution for attaching the sub-packaging.

In a further development, the attachment flap comprises a lock panel, preferably two lock panels, which lock panel is configured for locking into a cut in the first side wall of the box. The sub-packaging is attached to first side wall by inserting the attachment flap with folded lock panel(s) through the cut in the side wall, whereupon the lock panels are unfolded to lock the attachment flap in the side wall.

In some embodiments, the main body of the sub-packaging is box-shaped. Box-shaped is typically a rectangular prism shape.

The sub-packaging may suitably be folded from a blank, e.g. of the five-panel fold type. In that case the attachment flap is provided as an extension of one of the side panels of the blank.

In some embodiments, the main body of the sub-packaging comprises one or two open sides, the open sides preferably facing along the primary axis. Such a main-body may have a tubular shape or pipe-shape. In a main body having two open sides, the open sides preferably face in opposite directions along the primary axis, allowing long components to be accommodated by extending through the main body. A main body with one open side can accommodate an end-portion of a component, and two sub-packagings can thus accommodate one component.

In some embodiments, the sub-packaging is a bag, such as a paper bag. Such bags have an internal space defined the by bag walls, where the components typically occupy the part of the internal space which is located at a bottom the bag opposite to a top opening of the bag. The bag can be closed by pressing the parts of the bag walls which are located at the top opening against each other, thereby enclosing the components in the main body of the bag. The parts bag walls which are pressed against each other can thus form the attachment flap. Alternatively, the attachment flap may be provided as an extension of part of the bag or a separate attachment flap, suitably of cardboard or corrugated cardboard, attached to the bag.

In some embodiments, the sub-packaging comprises a removable portion configured for being separated from the rest of the sub-packaging by a break-zone. A break-zone is understood be a portion of the sub-packaging which has been deliberately weakened to facilitate tearing, opening or the like of the sub-packaging. The break-zone may comprise perforations or scoring. By providing a removable portion the installer can easily retrieve the sub-packaging from a fixed position on the box, such as a position where lock panels of the attachment flap lock the sub-packaging to the first side wall. The removable portion may also provide the installer with a way to easily open the sub-packaging and access the component(s) accommodated in the sub-packaging.

The removable portion may comprise the attachment flap. When the removable portion includes the attachment flap, the break zone is provided at or in connection with the attachment flap. In this way the attachment flap can provide leverage for tearing the sub-packaging open. Suitably the break zone is provided on a wall of the main body from which wall the attachment flap projects. Suitably, the removable portion covers at least 30% of the wall of the main body from which the attachment flap projects, preferably at least 50%. In this way the removable portion can provide an opening from which the components of the sub-packaging can be easily retrieved by the installer. The coverage of the removable portion is calculated as the fraction of the area which is removed from the wall of the main body to the total area of the wall.

In embodiments where the attachment flap is fixated to the first side wall in the supply condition, but released when the box is opened, the removable portion could be configured to remain attached to the rest of the sub-packaging after the having been used to open the sub-packaging. In this way the sub-packaging is kept in one piece, increasing the likelihood of the material being collected for recycling.

BRIEF DESCRIPTION OF DRAWINGS

In the following description embodiments of the invention will be described with reference to the schematic drawings in which.

Other embodiments and further advantages will be apparent from the following detailed description and drawings.

DESCRIPTION OF EMBODIMENTS

Figure 1:
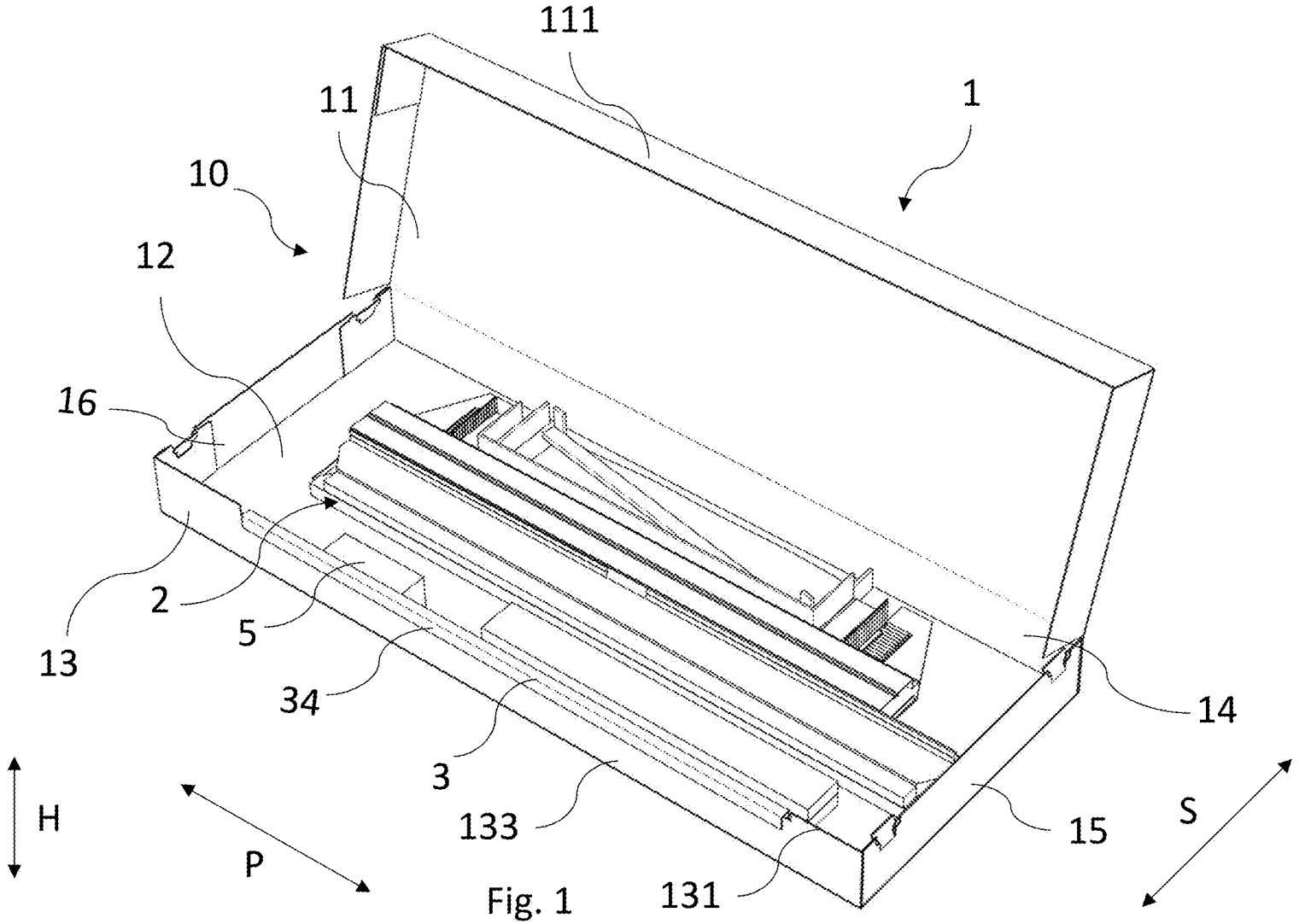
FIG. 1 is a perspective view of cardboard box containing a packed roof window product in the form of an installation kit for a roof window system, with a plurality of components.

Referring initially to FIG. 1 which shows a perspective view from above of a packed roof window product 1 packed in a box 10 of cardboard and of the five-panel fold type. The cardboard box is shown in an open state where a lid forming the top side 11 is open. The box 10 has a rectangular configuration and has a bottom side 12 and a four side walls 13-16, which side walls extend along a height axis H which is perpendicular to the bottom side 12. A first of the side walls 13 extends between side walls 15-16 along a primary axis P. Side walls 15-16 extend along a secondary axis S, the primary and secondary axis being perpendicular to the height axis and mutually perpendicular. In the embodiment of FIG. 1, the primary axis is longitudinal, and the secondary axis is transverse. The box 10 has an internal space which accommodates a plurality of window product related components 2. In this embodiment the components 2 include a flashing assembly and insulation frame side members, a gutter element 3 and a collection of components packed in a sub-packaging 5. The sub-packaging 5 is here a cardboard box which has an attachment flap (not visible) which is folded across an upper edge 131 of the first side wall 13 below the gutter element 3, whereby it extends from an inner surface (not shown) of the first side wall 13 to an outer surface 133 of the first side wall 13.

Figure 16:
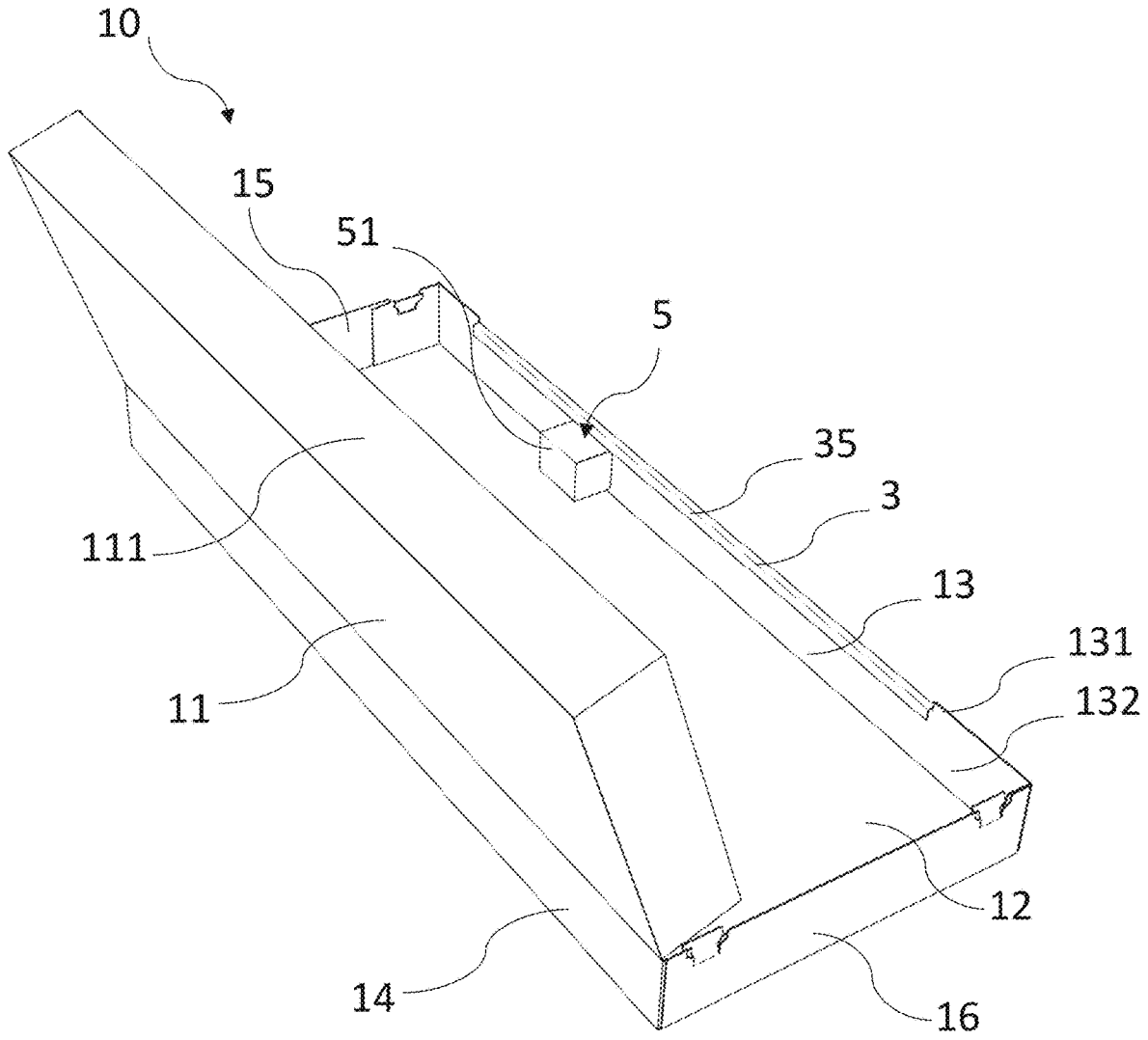
FIG. 16 shows the cardboard box of FIG. 1 from another angle without the plurality of components.

In the supply condition the lid 11 is closed and the attachment flap will be locked in between first side wall 13 and the gutter element 3 by the top side 11. In this way the sub-packaging 5 is fixated in relation to the box 10 without the use of auxiliary fastening means. See also FIG. 16 showing the box 10 from another angle without the collection of components 2.

The lid 11 of the box further comprises an overlap panel 111 which is attached to the outer surface 133 of the first side wall 13 in the supply condition.

Figure 2A:
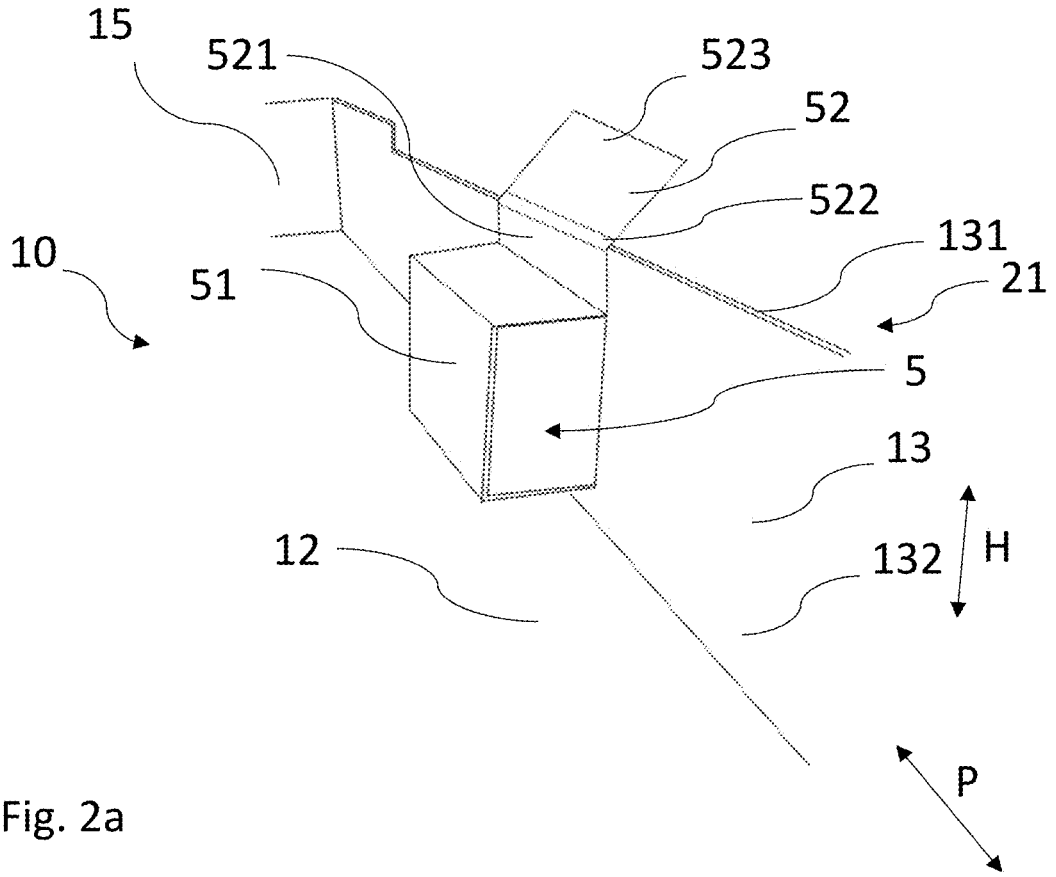
FIG. 2*a-b* are perspective views from inside and outside of a box respectively, where a sub-packaging is being attached to the side wall of the box.
Figure 2B:
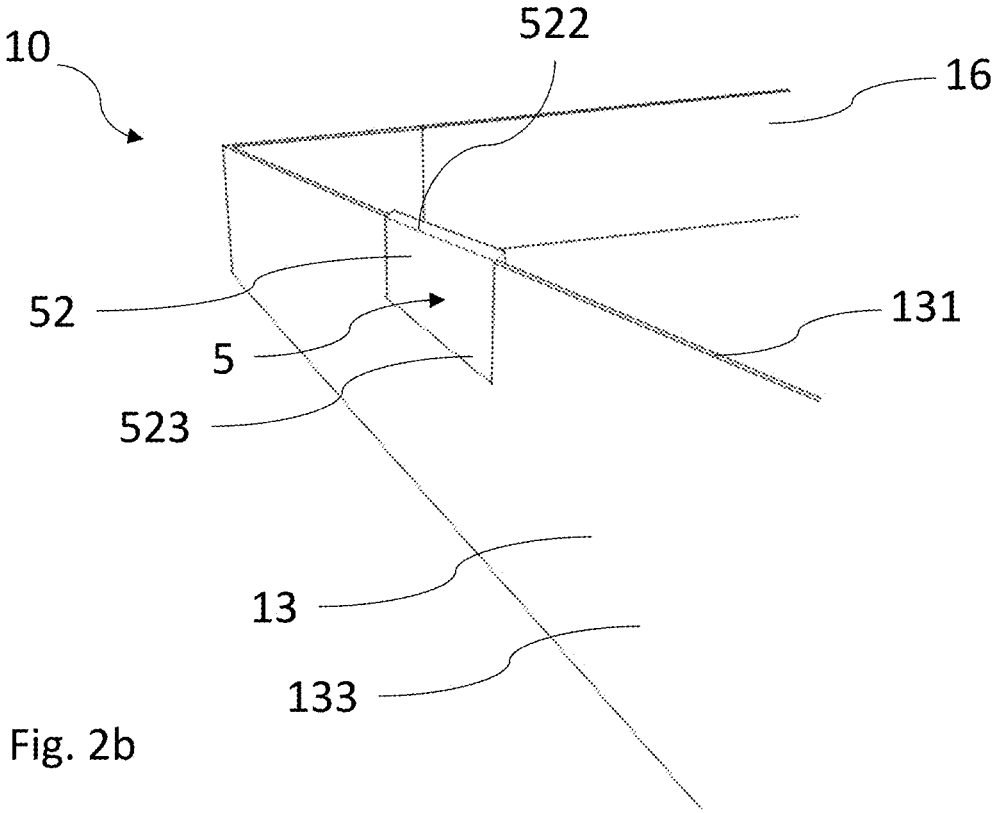
Figure 3:
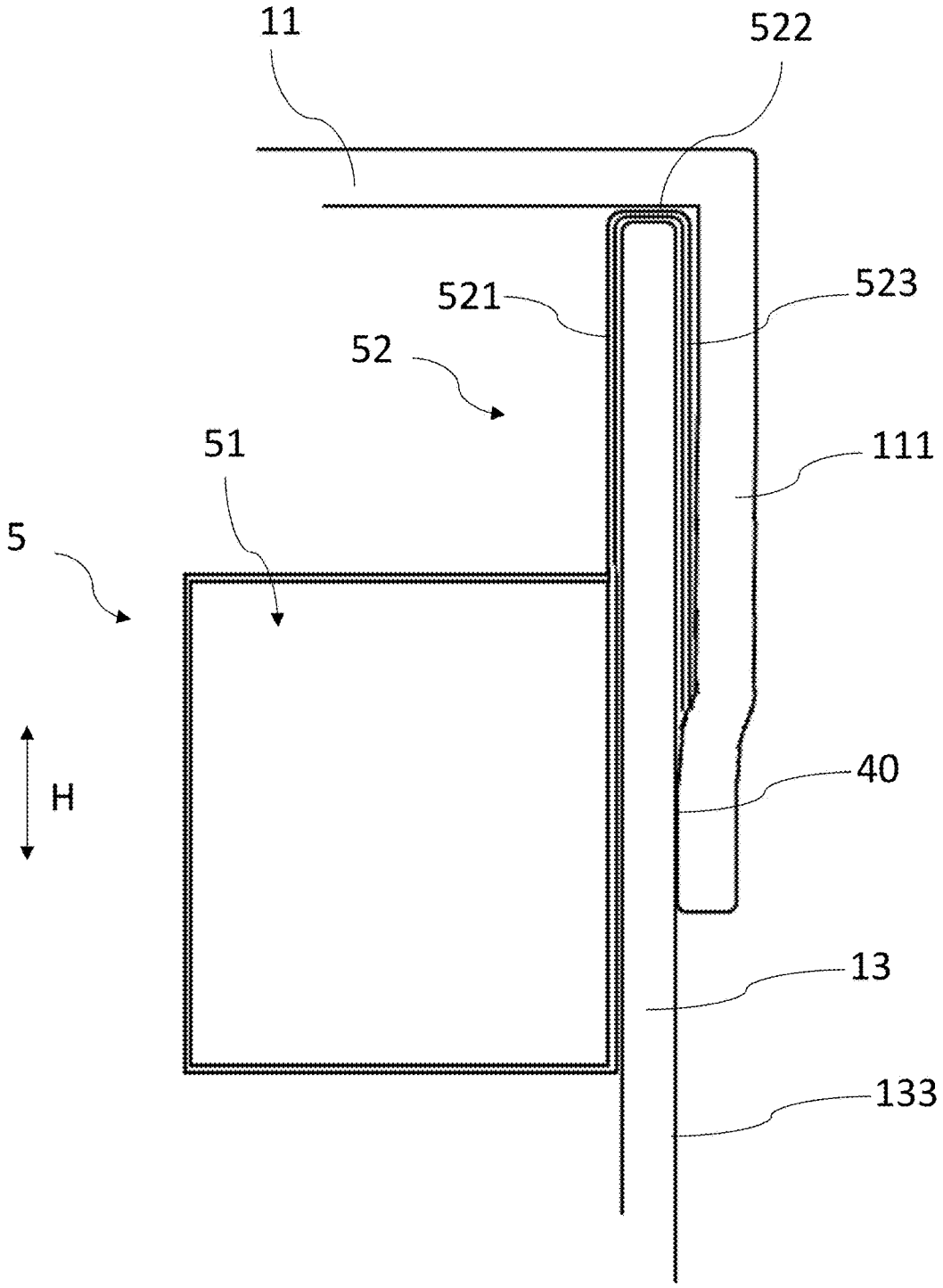
FIGS. 3 and 4 show cross-sectional views of a sub-packaging attached the first side wall.
Figure 4:
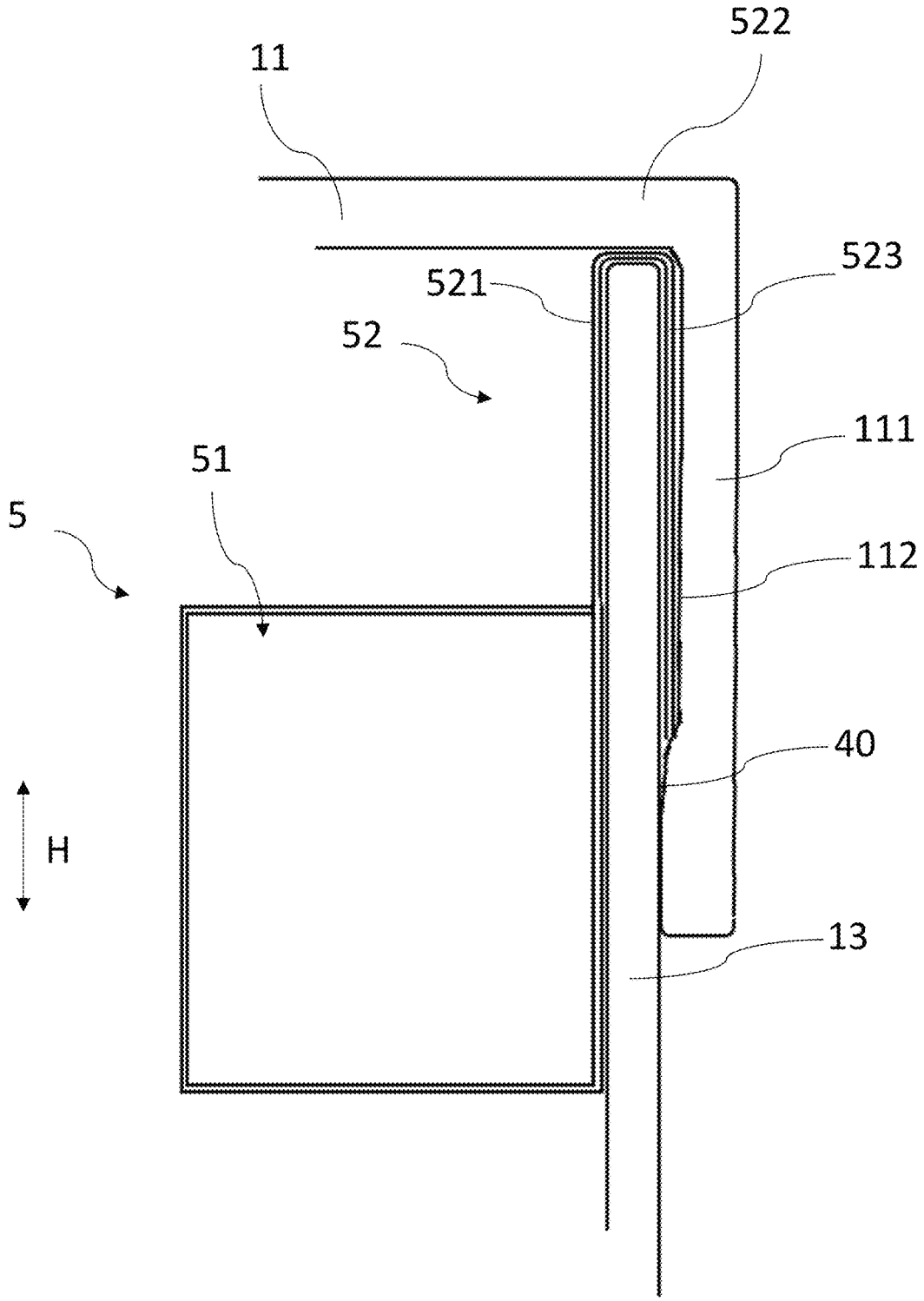

Referring now to FIGS. 2*a* and 2*b* showing perspective views from respectively inside and outside of two embodiments of a box 10 with a sub-packaging 5 being packed therein. The sub-packaging 5 is identical in the two figures and comprises a main body 51 which accommodates a collection of components. The main body 51 is here a box shaped as a rectangular prism. The attachment flap 52 projects from the main body 51 and is in this embodiment an extension of the wall of the main body which rests against the first side wall 13. The attachment flap is here shown as a thin material, but in practice the attachment flap 52 will usually be made from the same material as the main body, such as from corrugated cardboard. The attachment flap 52 has a first section 521 proximal to the main body 51, which first section 521 extends along an inner surface 132 of the first side wall, and a folding zone 522 by which the attachment flap 52 is folded across the upper edge 131 of the first side wall 13. When the attachment flap is folded across the first side wall, a second section 523 extends along the outer surface 133 of the first side wall as seen in FIG. 2*b*. The sections 521, 523 of the attachment flap are in contact with respective surfaces 131, 133 of the first side wall 13. When all components have been packed in the box 10, the lid (not shown) is closed and an overlap panel (not shown) is glued to the outer surface 133 of the first side wall 13, sandwiching the second section 523 in between the overlap panel and side wall as shown in FIGS. 3 and 4. In the embodiment of FIG. 2*a* the first side wall 13 is provided with a recess 21 and the attachment flap 52 is folded across an upper edge 131 of the first side wall so that it is located in the recess, whereas in FIG. 2*b* the first side wall 13 has a uniform height. The recess 21 is provided for suspending the gutter element 3 as shown in FIG. 1. The sub-packaging 5 is here shown in a configuration where it is suspended from the first side wall 13, leaving room between the main body 51 and the bottom side 12 which could potentially be used for other components. Alternatively, the sub-packaging can rest on the bottom side 12.

Referring now to FIGS. 3 and 4 which show cross sections of a side of the box in the supply condition as seen along the primary axis. The lid 11 and the overlap panel 111 fixates the attachment flap to the first side wall 13 by being in contact with the folding zone 522 and second section 523 of the attachment flap. The sub-packaging 5 is here made from a material which is thinner than the material of the box 10, but in practice both may be made from cardboard having similar or equal thickness. The overlap panel 111 is fastened to the outer surface 133 of the first side wall by a strip of glue 40. In FIG. 3 the cardboard material is sufficiently flexible for allowing it to be slightly deformed at its lower end, to accommodate the attachment flap. FIG. 4 shows an alternative embodiment where the overlap panel has a zone of reduced thickness 112, which corresponds in size to the second section 523 of the attachment flap. In this way space is provided for the second section 523, reducing or eliminating the strain on the overlap panel 111 caused by the second section 523 thereby potentially improving the attachment through strip of glue 40. The zone 112 is here a compressed zone but might also be made in other ways, for example by removal of material.

Figure 5A:
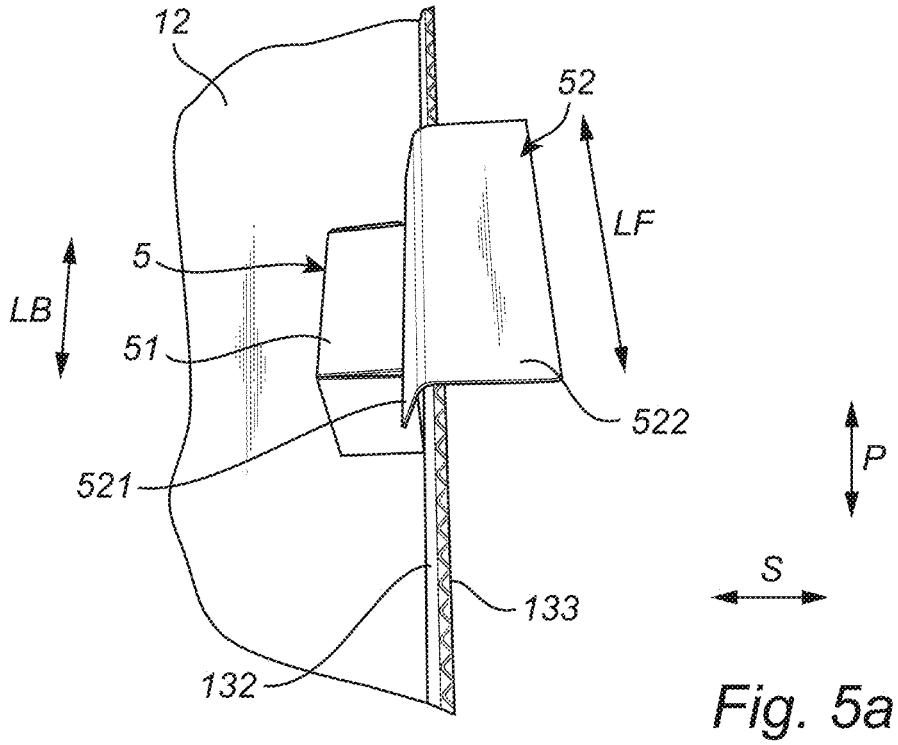
FIGS. 5*a-b* are perspective views similar to FIGS. 2*a-b*, but both seen from the inside of the box.
Figure 5B:
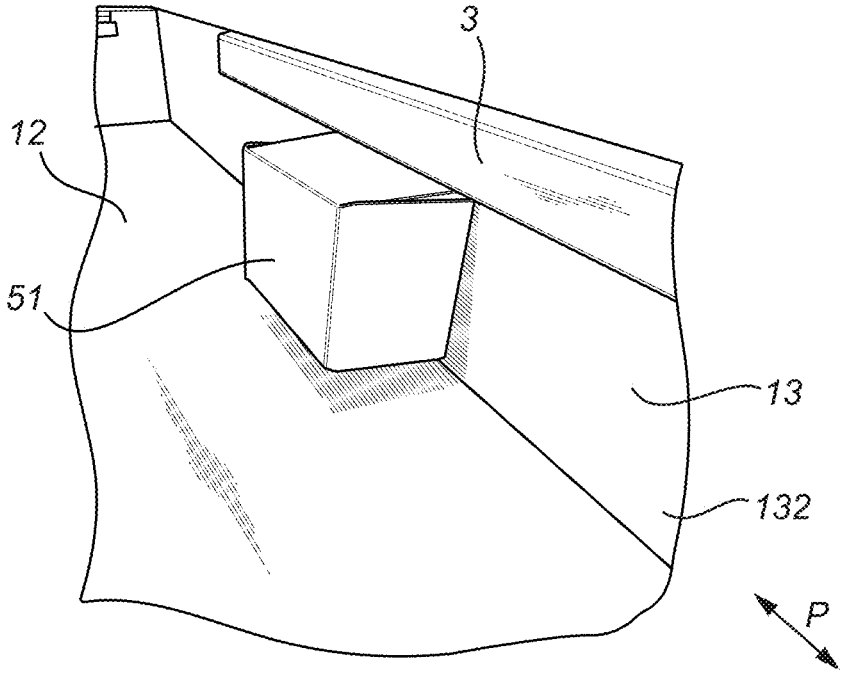

Referring now to FIGS. 5*a-b* which show perspective views of a sub-packaging 5 of corrugated cardboard being packed in a box 10 of corrugated cardboard. In FIG. 5*a* the attachment flap 52 is folded across the upper edge 131 of the side wall, and in FIG. 5*b* a gutter element 3 has been positioned over the attachment flap 52 riding on the upper edge of the first side wall 13.

The attachment flap 52 is in this embodiment longer than the main body 51 of the sub-packaging 5. The attachment flap has length Lf and the main body has length Lb, both measured along the primary axis P when the sub-packaging 5 positioned at the first side wall 13. The longer attachment flap 52 increases friction, preventing the sub-packaging 5 from sliding along the first side wall 13, and also hinders rotation about the secondary axis S.

Figure 6:
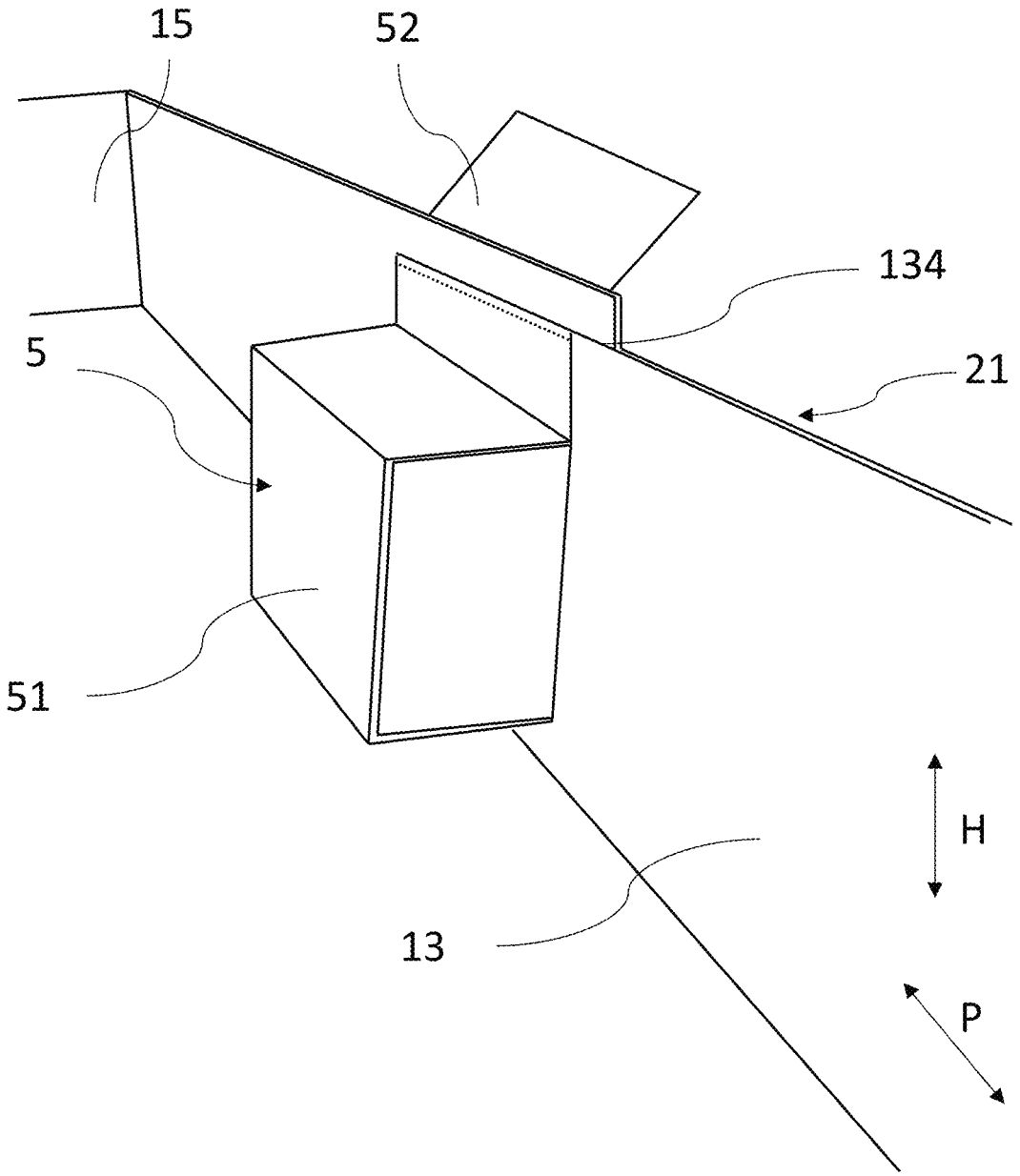
FIG. 6 is a perspective view of a sub-packaging extending through a cut in the side wall.

Referring now to FIG. 6 which shows an embodiment wherein the attachment flap 52 extends across the first side wall 13 by extending through a cut 134 in the first side wall 13, said cut being made in continuation of a recess 21. By providing the cut 134 the sub-packaging may also be prevented from moving around during the packing process, making it easier for the operator to pack the window related product. The cut also provides a predetermined position for the sub-packaging and thus serves as a guide for the operator in positioning the sub-packaging.

Figure 7:
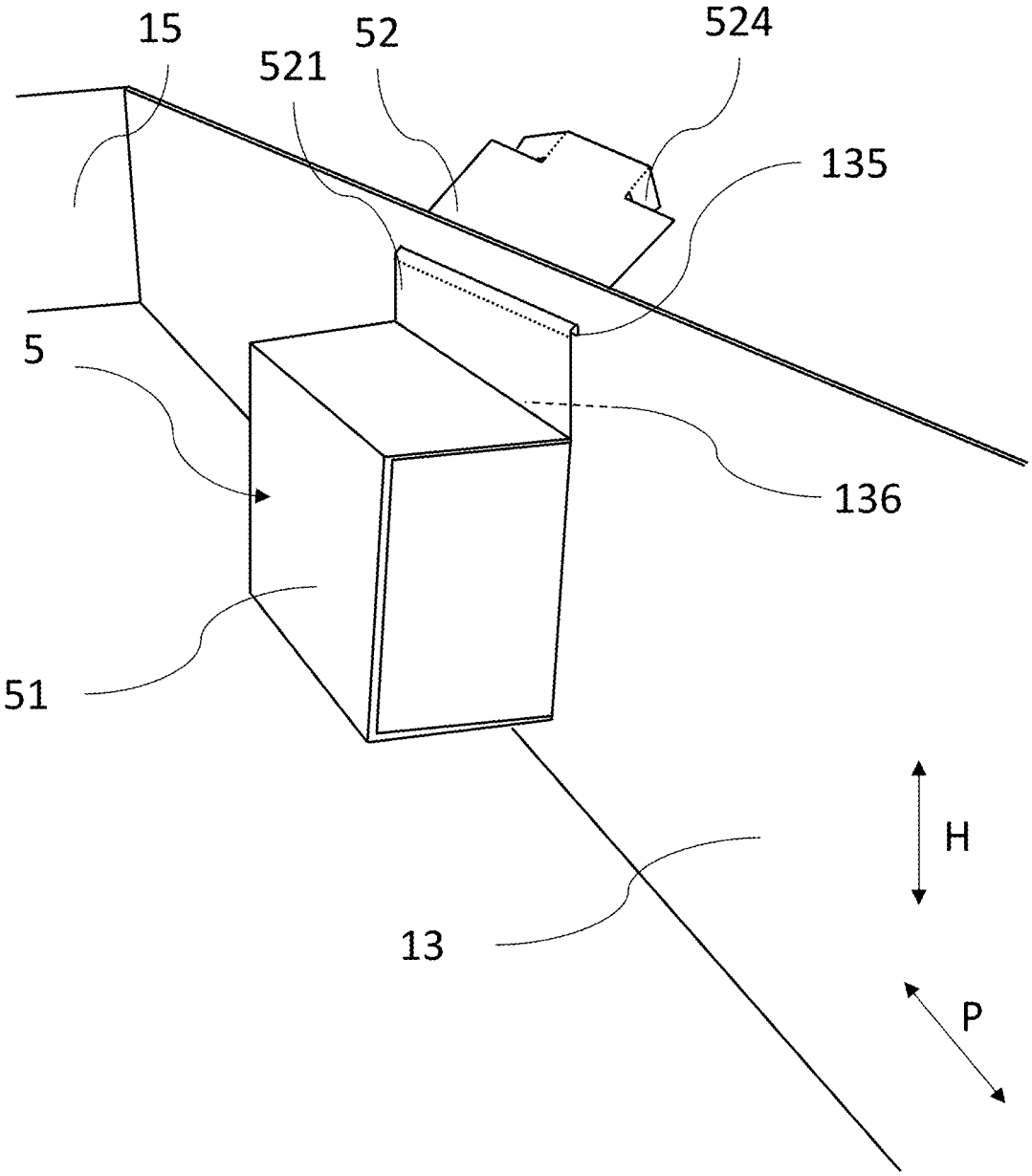
FIGS. 7 to 9 are perspective views of further embodiments of the sub-packaging, wherein the attachment flap comprises lock panels for locking to a cut in the side wall of the box.
Figure 8:
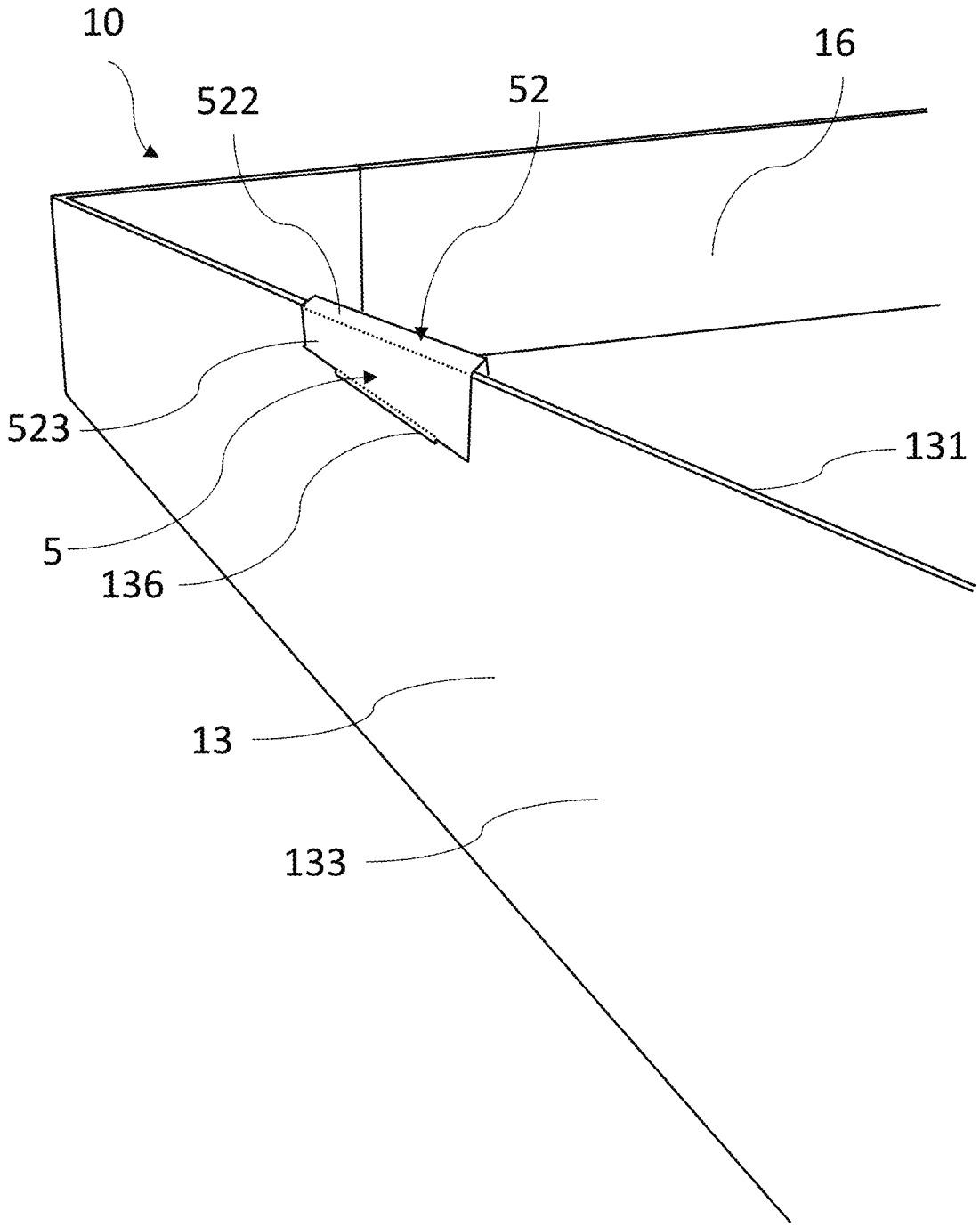
Figure 9:
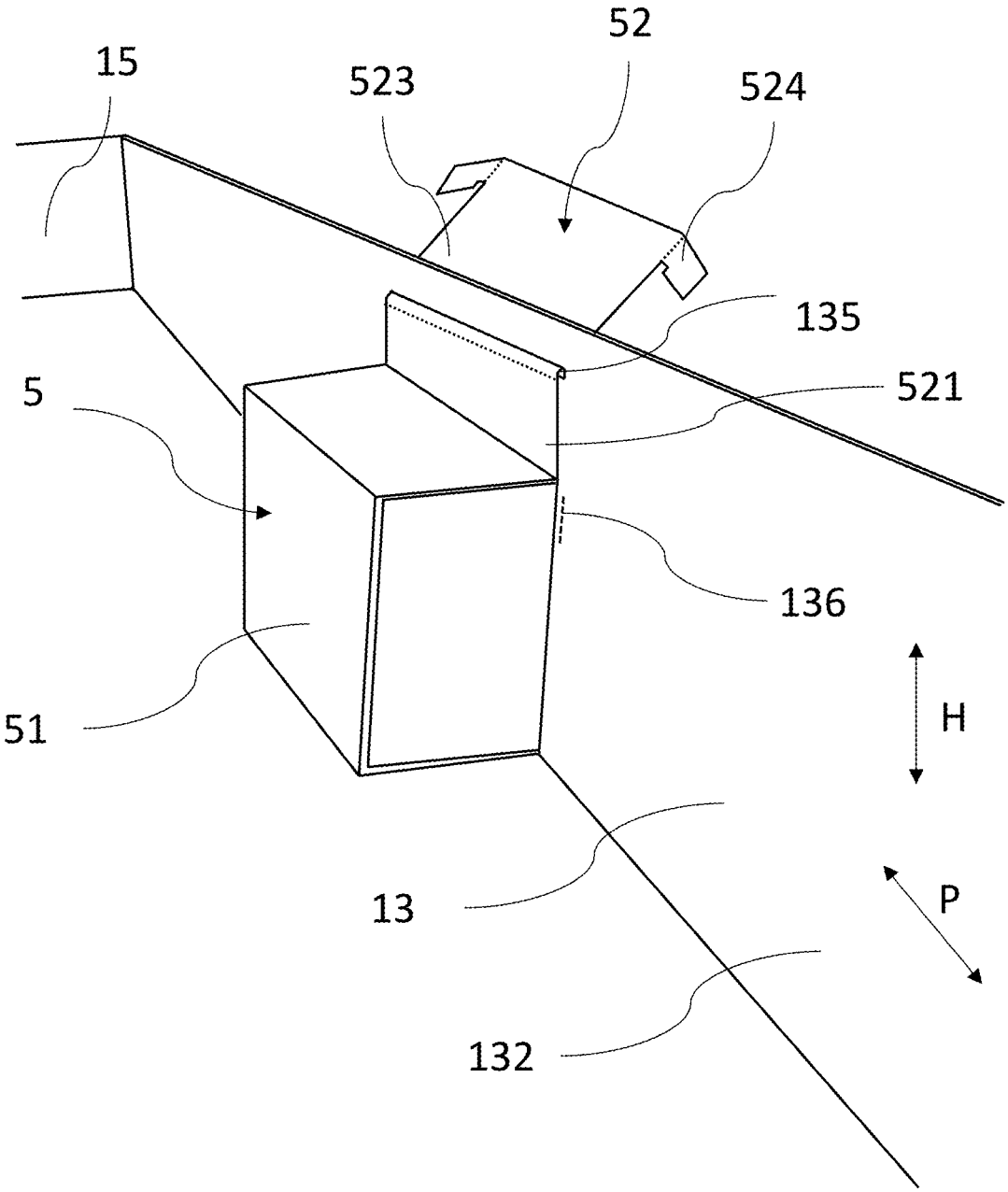

Referring now to FIGS. 7 to 9 showing embodiments where the attachment flap 52 is provided with lock panels 524 (only visible in FIGS. 7 and 9) for locking the sub-packaging to the first side wall 13. FIGS. 7 and 8 show embodiments of lock panels 524 provided by cuts in the attachment flap 52 and FIG. 9 shows an embodiment where the lock panels 524 project from the attachment flap 52.

In the embodiment of FIG. 7 the first side wall 13 is provided with two cuts 135 and 136 along the primary axis. The lower cut 136 is not visible in FIG. 7, but is similar to the cut 136 in FIG. 8, as it is shorter than the upper cut 135 and is thus covered by the first section 521 of the attachment flap. The sub-packaging 5 is attached by inserting the attachment flap 52 through the upper cut 135, such that the attachment flap 52 extends across the first side wall 13. Then the attachment flap 52 is folded down with the lock panels folded towards each other, and inserted through the lower cut 136, whereupon the lock panels 524 are unfolded on the inside of the box 10. As the lower cut 136 is shorter than the upper cut 135, the unfolded lock panels prevent the attachment flap from being retracted from the lower cut 136 and the sub-packaging is thus fixated to the first side wall 13.

FIG. 8 shows an alternative design employing only one cut 136, where the attachment flap is locked in cut 136 by unfolding lock panels 524 as shown in and described with reference to FIG. 7 and is then folded across the upper edge 131 of the first side wall 13.

FIG. 9 shows an embodiment where projecting lock panels 524 are to be inserted through a pair of cuts 136 extending along the height axis to lock the sub-packaging 5 to the first side wall 13. The lock panels 524 each have an indentation to improve retainment of the lock panels 524 in the first side wall 13. The sub-packaging 5 is here shown in an embodiment, which rests on the bottom side 12 of the box. Embodiments having lock panels 524 can be used if a more secure fixation of the sub-packaging is desired, but embodiments wherein the attachment flap is simply folded across the first side wall 13 and fixed by overlapping panels as shown in FIGS. 2*a* to 4, and not weaved in the to the side wall, will be sufficient for most components.

Figure 10:
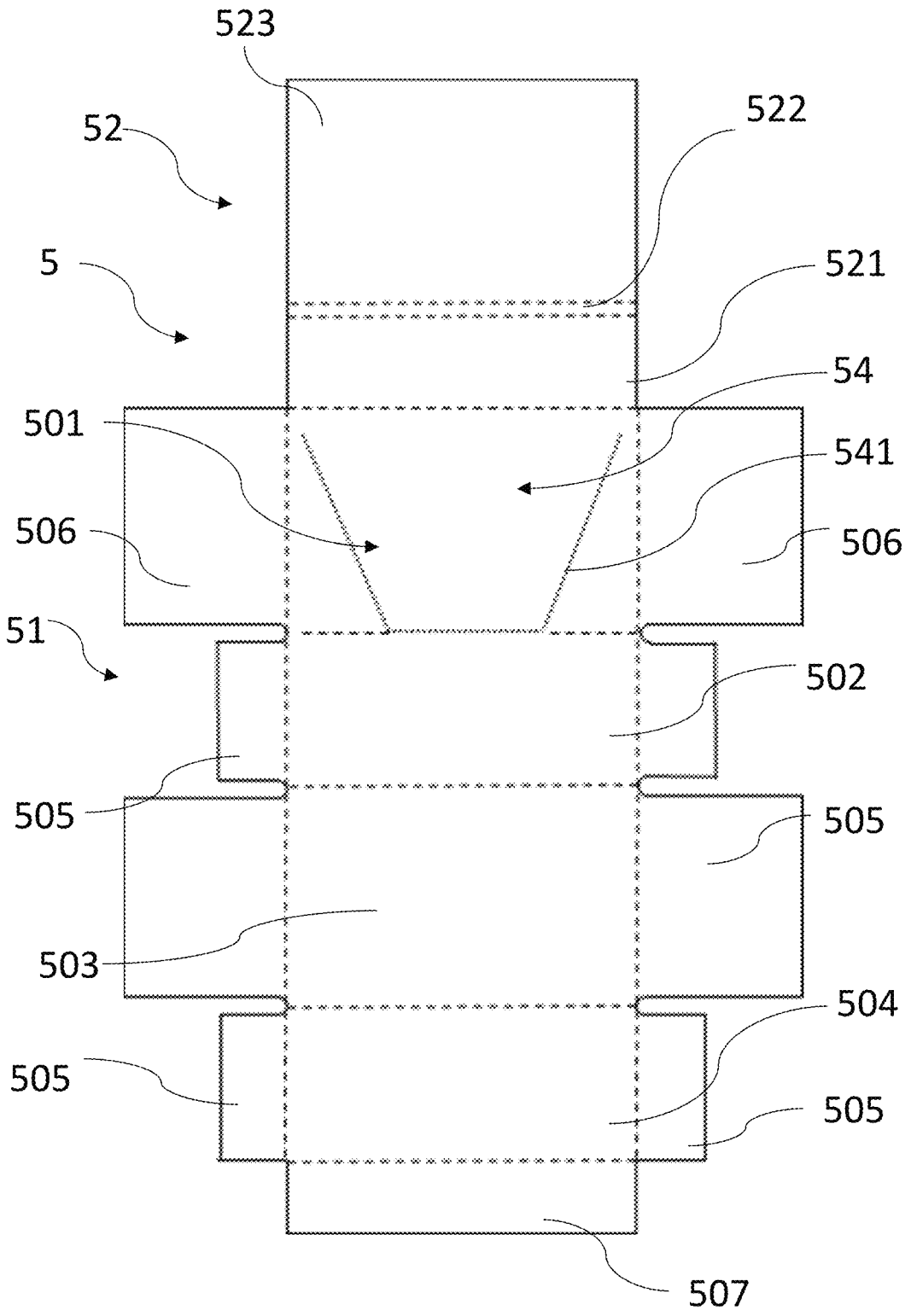
FIG. 10 shows a blank for a sub-packaging box of the five-panel fold type.
Figure 11:
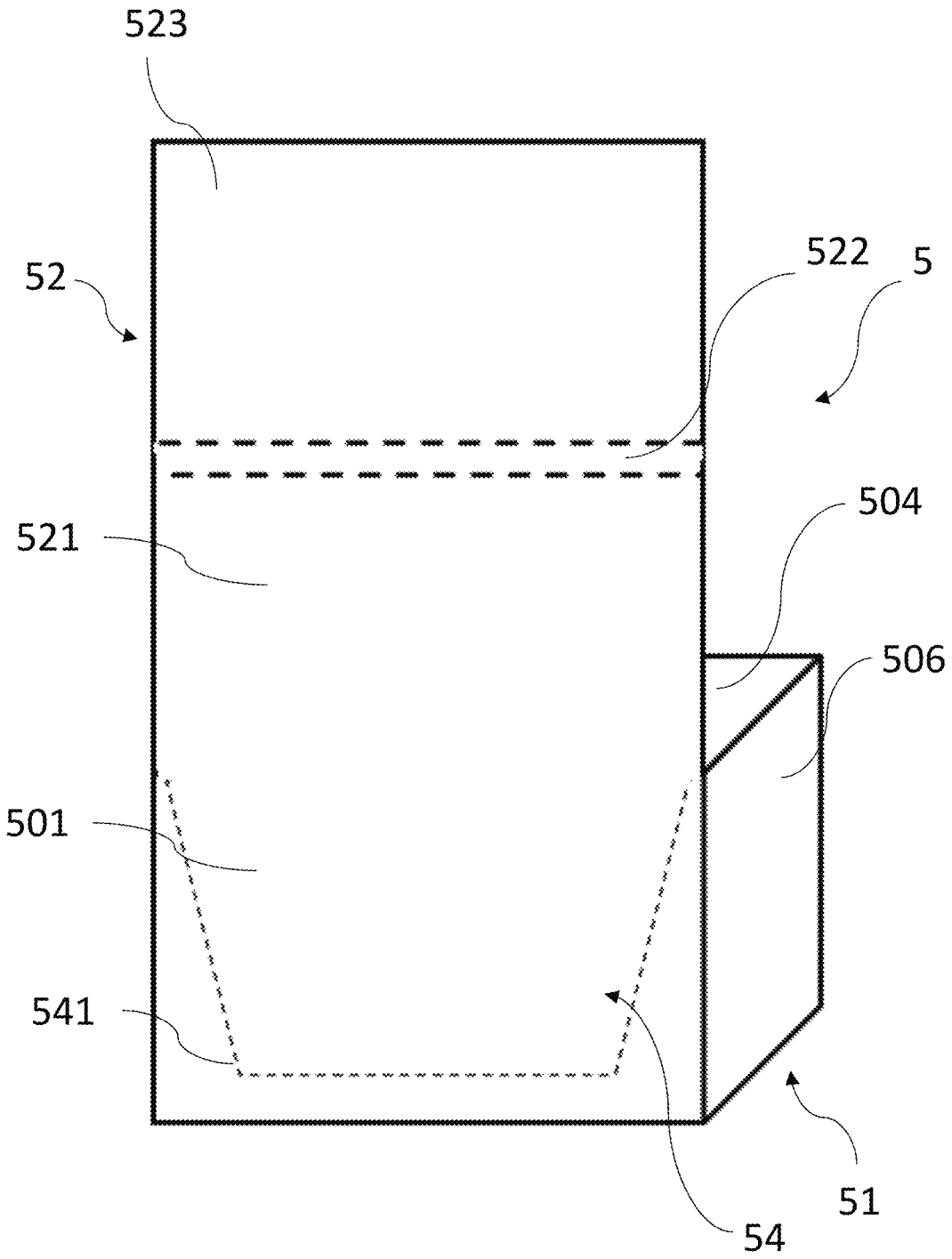
FIG. 11 shows the blank of FIG. 10 in the folded state, FIG. 12 show another embodiment of a sub-packaging having an open side.

Referring now to FIGS. 10 and 11 which shows a blank for a sub-packaging box 5 and sub-packaging box 5 folded from said blank, respectively. The blank 5 is here of the five-panel fold type, where the main body 51 is formed by a lid panel 501, a bottom panel 503 and two side panels 502, 504 as well as six side flaps 505 which will form the remaining two side walls. The dashed lines represent folding lines. In this embodiment the side flaps 505 are to be glued together in a folded state to form the main body 51. As an alternative to glue, the blank could have interlocking panels. The lid panel 501 has overlap panels 506 which in the folded state are glued to the side flaps 505 to close the sub-packaging 5. The blank further has panel 507, which in the folded state extends beneath the lid panel 501 and may be glued thereto.

The attachment flap 52 is integrated with main body 51, being an extension of the lid panel 501. The first section 521 and second section 523 are delimited from each other by a folding zone 522 which is indicated by dashed folding lines. The sub-packaging 5 further has a removable portion 54, which here includes the attachment flap 52 and a portion of the lid panel 501, which removable portion 54 is delimited by a break-zone 541 provided on the lid panel 501. Lid panel 501 is the wall of the of sub-packaging 5 from which the attachment flap 52 projects. The break zone is here perforation lines 541 which are shown as dotted lines. The removable portion 54 is thus a weakened portion of the lid panel and by tearing the attachment flap 52 from the main body, a part of the lid panel 501 will be torn away with the attachment flap 52, providing an opening in the sub-packaging 5 through which the contents can be retrieved. In this embodiment, the part of the lid panel 501, which is removed, covers about 70% of the area of the lid panel 501. In embodiments where the sub-packaging 5 is released from the first side wall of the box upon opening on the box, such as the ones shown in FIGS. 2*a* to 4, the attachment flap 52 provides leverage for the operator, facilitating the opening of the sub-packaging. In other embodiments, where the sub-packaging 5 is securely fixed to the first side wall also when the box is open, e.g. by lock panels as in FIGS. 7 to 9, the removable portion 54 allows the operator to simply tear the sub-packaging 5 from the first side wall 13 while at the same time opening the sub-packaging 5. As the attachment flap 52 is thus left behind on first side wall 13 there is no need to separately collect it for recycling and the likelihood of it being blown away by wind at the installation site is reduced, increasing the likelihood that it will be recycled. The panel 507 may also serve to keep the components from inadvertently falling out of the sub-packaging when the removable part 54 is removed.

Figure 14:
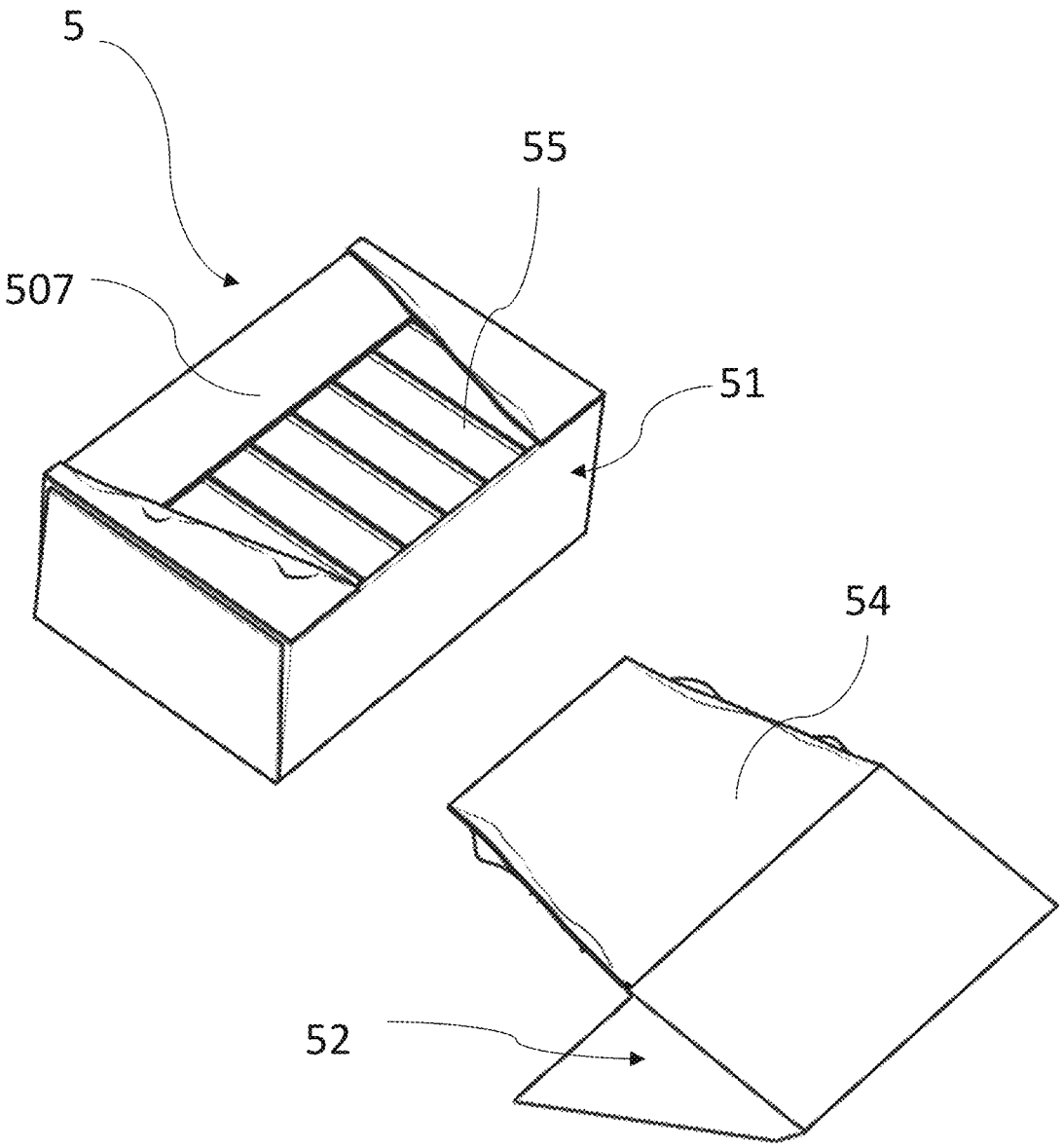
FIG. 14 shows a sub-packaging of the type shown in FIGS. 10-11 in an opened state.

A sub-packaging 5 opened by tearing a cardboard material at a break-zone in the manner described above is shown in FIG. 14. In this embodiment the break-zone extends along the joint between panels 501 and 502. The removable portion 54 (shown in part in FIG. 14) has been separated entirely, but this need not be the case. The component 55 accommodated in the sub-packaging has been exposed but is still retained by panel 507.

Figure 12:
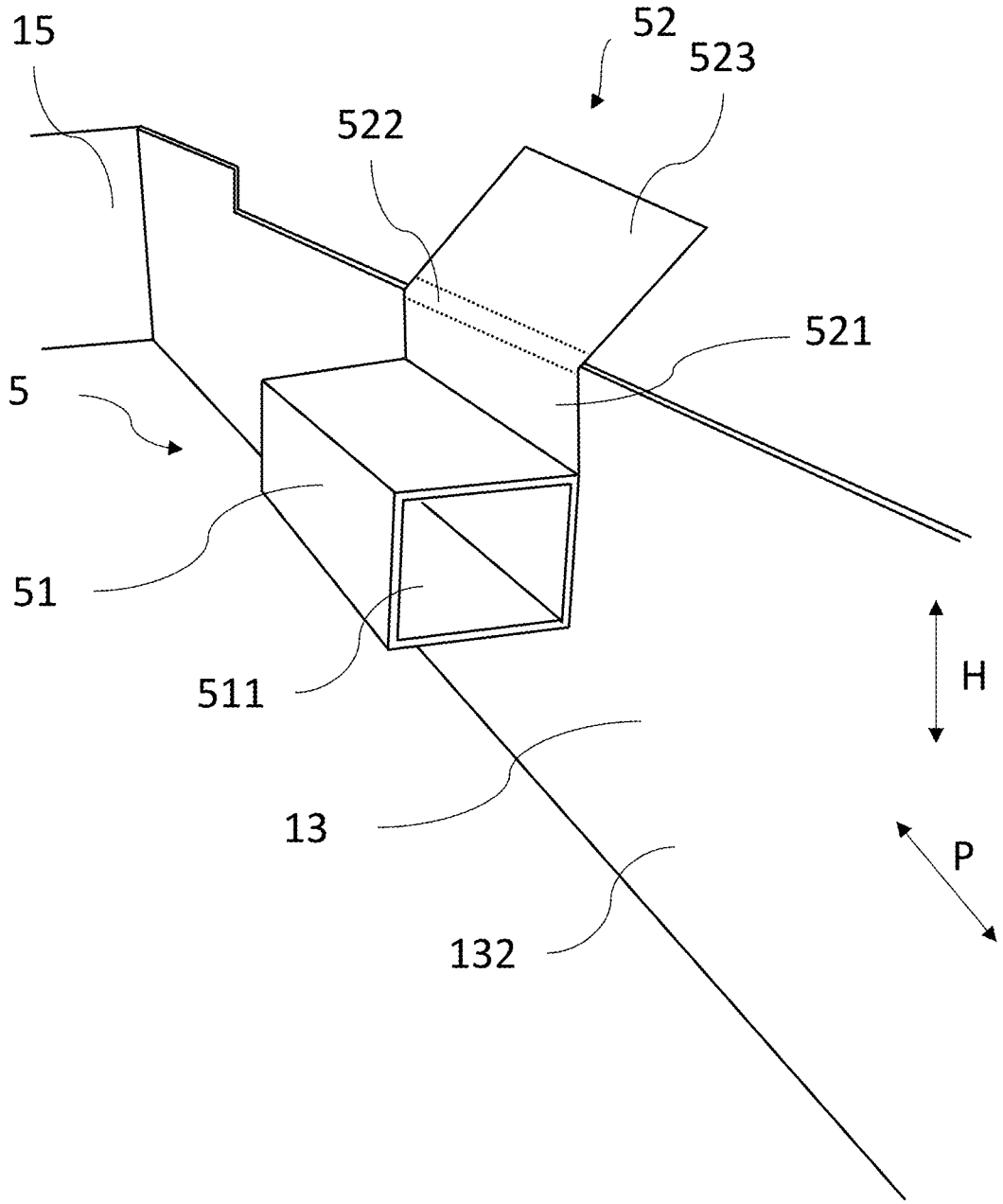
Figure 13:
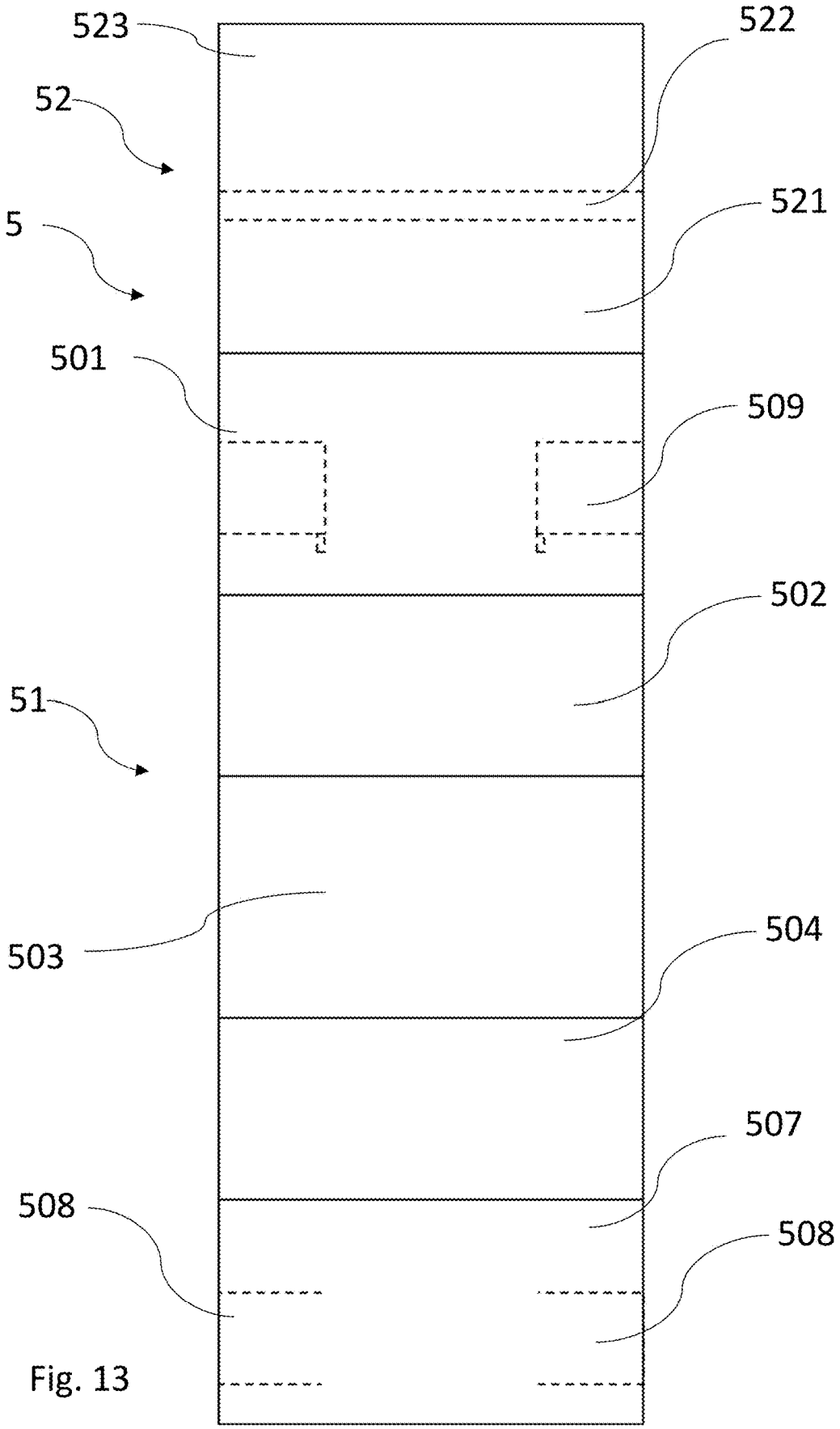
FIG. 13 shows a blank for the sub-packaging of FIG. 12.

Referring now to FIGS. 12 and 13 showing another embodiment of a box-shaped sub-packaging 5 which is provided with an open side 511 and a blank for folding such a sub-packaging respectively. The blank 5 of FIG. 13 has a panel 501 which is provided with a cut-out 509 in which interlocking flaps 508 can lock in the folded state. Open-sided sub-packaging can be used for long components where only part of a component is accommodated in the internal space of the sub-packaging. For example, two pieces of sub-packaging each with one open side can accommodate either end of a long component. Alternatively, or additionally, the component can extend through one or more sub-packaging with two open sides.

In the shown embodiments the box 10 is of the five-panel fold type, where the lid 11 is hinged at one of the side walls and is provided with overlap flaps 111 to be attached the outer surface of the remaining side walls. Other types of box-designs could also be used, such as a telescopic box design, where the box formed by two separate parts; a bottom part forming the bottom side and side walls of the box and a top part forming the top side and having overlap panels which in the supply condition overlap at least partly with the side walls of the side walls of the bottom part.

Figure 15A:
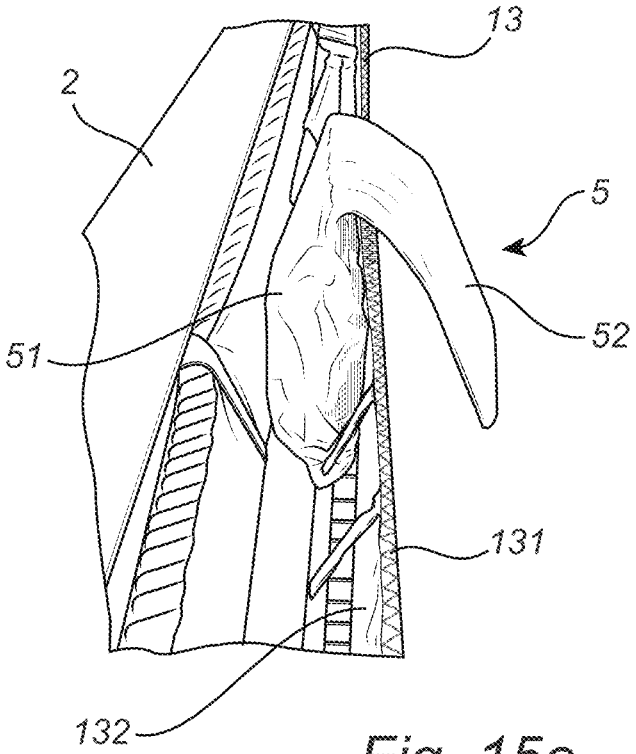
FIGS. 15*a-b* shows a sub-packaging bag being attached to the side wall of the box.
Figure 15B:
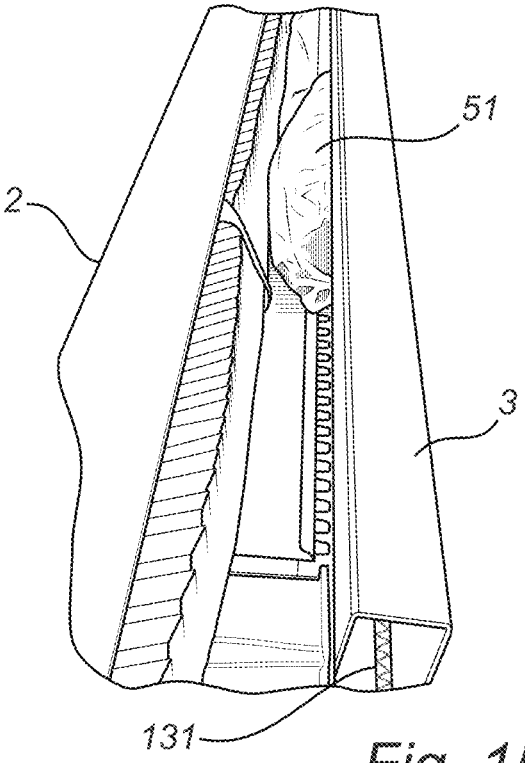

In FIGS. 1-14, the sub-packaging 5 has been shown as boxes with a rectangular prism shape. Other shapes can be used depending on the component(s) to be accommodated, such as tubular shapes or irregular shapes such as a paper bag. In the embodiment of FIGS. 15*a* and 15*b* the sub-packaging is a paper bag 5 in the process of being attached the first side wall 13. The main body 51 has an irregular shape and is positioned at the inner surface 132 and the attachment flap is folded across the upper edge 131. As can be seen, parts of the bag walls have been pressed against each other, forming the attachment flap 52 and sealing off the main body 51. In FIG. 15*b* a gutter element 3 has been positioned over the attachment flap 52 and is thus carried the upper edge of the first side wall 13, thereby attaching the paper bag 5 to the first side wall 13.

LIST OF REFERENCE NUMERALS

1 Packed roof window product
2 Window product related components
3 Gutter element
5 Sub-packaging
51 Main body
501 Top panel
502 Side panel
503 Bottom panel
504 Side panel
505 Side flaps
506 Overlap panel
507 Panel
508 Cut-out
509 Interlocking flaps
52 Attachment flap
521 First section
522 Folding zone
523 Second section
524 Lock panel
54 Removable portion
541 Break zone
55 Component
10 Cardboard box
11 Top side, Lid
111 Overlap panel
112 Zone of reduced thickness
12 Bottom side
13 First side wall
131 Upper edge
132 Inner surface
133 Outer surface
134 Cut
135 Cut
136 Cut
14 Side wall
15 Side wall
16 Side wall
21 Recess
40 Strip of glue
Lf Length of attachment flap
Lb Length of main body

The invention claimed is:

1. A packed roof window product comprising a plurality of differently sized roof window related product components accommodated in a box, wherein the box in a supply condition has a bottom side and a top side, which bottom side and top side are spaced apart along a height axis and side walls of the box extend between the bottom side and top side of the box along the height axis, said bottom side, top side and side walls delimiting an internal space of the box, and wherein a first of the side walls extends along a primary axis, which primary axis is perpendicular to the height axis, and the first side wall has an upper edge extending along the primary axis along the top side, an outer surface facing away from the internal space, and an inner surface facing towards the internal space, wherein a first of the components or a collection of components is accommodated by a sub-packaging, the sub-packaging being accommodated in the internal space of the box, the sub-packaging comprising a main body, which main body delimits an internal space accommodating the first component or component collection, the sub-packaging further comprises an attachment flap projecting from the main body, and the sub-packaging is attached to the first side wall by the attachment flap extending across the first side wall from the inner surface to the outer surface.

2. The packed roof window product according to claim 1, wherein at least one of the box and the sub-packaging is made from a paper-based material.

3. The packed roof window product according to claim 1, wherein the attachment flap is integrally formed with the main body of the sub-packaging.

4. The packed roof window product according to claim 1, wherein the attachment flap comprises a first section and a second section, which first and second sections are delimited from each other by a folding zone of the attachment flap, wherein the first section extends along the inner surface of the first side wall and the second section extends along the outer surface of the first side wall.

5. The packed roof window product according to claim 1, wherein the attachment flap is folded across the upper edge of the first side wall.

6. The packed roof window product according to claim 1, wherein the top side of the box is formed by a lid of the box, and the attachment flap is retained in relation to the first side wall of the box by the lid of the box in the supply condition.

7. The packed roof window product according to claim 1, wherein the box comprises an overlap panel, which overlap panel in the supply condition overlaps with an outer surface of the first side wall and with a part of the attachment flap which is positioned at the outer surface of the first side wall.

8. The packed roof window product according to claim 7, wherein at least one of the overlap panel and the first side wall is provided with a zone of reduced thickness, and wherein said zone corresponds in size and shape at least to the part of the attachment flap which is positioned at the outer surface of the first side wall.

9. The packed roof window product according to claim 7, wherein at least one of the overlap panel and the first side wall is provided with a compressed zone of reduced thickness and wherein said compressed zone corresponds in size and shape at least to the part of the attachment flap which is positioned at the outer surface of the first side wall.

10. The packed roof window product according to claim 1, wherein the attachment flap extends across the first side wall by extending through a cut in the first side wall of the box.

11. The packed roof window product according to claim 10, wherein the attachment flap comprises at least one lock panel being configured for locking into a cut in the first side wall of the box.

12. The packed roof window product according to claim 10, wherein the attachment flap comprises two lock panels each being configured for locking into a cut in the first side wall of the box.

13. The packed roof window product according to claim 1, wherein the main body of the sub-packaging is box-shaped.

14. The packed roof window product according to claim 1, wherein the main body of the sub-packaging comprises one or two open sides, the one or two open sides facing along the primary axis.

15. The packed roof window product according to claim 1, wherein the sub-packaging comprises a removable portion configured for being separated from a remaining portion of the sub-packaging by a break-zone.

16. The packed roof window product according to claim 15, wherein the removable portion comprises the attachment flap.

17. The packed roof window product according to claim 15, wherein the break zone is provided on a wall of the main body from which wall the attachment flap projects.

18. The packed roof window product according to claim 17, wherein the removable portion includes at least 30% of the area of the wall of the main body from which the attachment flap projects.

19. The packed roof window product according to claim 17, wherein the removable portion includes at least 50% of the area of the wall of the main body from which the attachment flap projects.

20. The packed roof window product according to claim 1, wherein the main body has a length Lb as seen along the primary axis, and the attachment flap has a length Lf as seen along the primary axis, wherein the length Lf exceeds the length Lb.

* * * * *